US005351672A

United States Patent [19]

Barden, III

[11] Patent Number: 5,351,672

[45] Date of Patent: Oct. 4, 1994

[54] MASONRY HEATER WITH REPLACEABLE THROAT CONSTRUCTION

[76] Inventor: Albert A. Barden, III, RFD 1, Box 640, Norridgewock, Me. 04957

[21] Appl. No.: 95,690

[22] Filed: Jul. 21, 1993

[51] Int. Cl.[5] ..... A21B 1/00

[52] U.S. Cl. ..... 126/19 R

[58] Field of Search ..... 126/19 R, 20.1, 273 R, 126/8

[56] References Cited

U.S. PATENT DOCUMENTS 926,910 7/1909 Taylor ..... 126/8

5,168,862 12/1992 McGee ..... 126/8

OTHER PUBLICATIONS

*Finnish Fireplace Construction Manual* Jun. 1984 by Albert A. Barden, III Published in Sep. 1984 by Maine Wood Heat Company, Inc., RFD 1, Box 640 Norridgewock, Maine USA 04957.

*Finnish Fireplaces Heat of the Home* by Albert Barden and Heikki Hyytiainen, Published by Heikki Hyytiainen and Building Book Ltd., Finland, c/o Maine Wood Heat Company, Inc., RFD 1, Box 640, Norridgewock, Me. 04957.

*Primary Examiner*—Carroll B. Dority

*Attorney, Agent, or Firm*—Daniel H. Kane

[57] ABSTRACT

A masonry heater (11) confines combustion within a core (15) of refractory material construction. The core includes a primary combustion firebox (18) with fuel access firebox door (20) and a secondary combustion chamber bakeoven (25) over the firebox (18) with a bakeoven access door (26). A tapered throat (35) provides a flue coupling from the firebox (18) to the bakeoven (25). The tapered throat (35) is constructed from a plurality of unmortared replaceable refractory bricks accessible for replacement through the bakeoven door (26). The tapered throat refractory bricks (80,86) are constructed in configurations to rest on each other and provide a structurally self supporting tapered throat structure (55) with at least two sloping sides. The core (15) is constructed with a first course (50) of shelf firebricks (52) providing shelf projections (50,52,54) for supporting the unmortared replaceable refractory bricks (80,86) of the tapered throat structure (55). The sloping sides of the tapered throat are symmetrical and are preferably oriented at the sides of the firebox (18), but can also be oriented from front to back. A second course (60) of shelf firebricks (62) spaced above the first supports a removable floor of the secondary combustion chamber or bakeoven (25).

20 Claims, 6 Drawing Sheets

MASONRY HEATER WITH REPLACEABLE THROAT CONSTRUCTION

TECHNICAL FIELD

This invention relates to masonry heaters of the type combining a bakeoven or an accessible secondary combustion chamber with the masonry heater. The masonry heaters of this type are also known as Finnish fireplaces with contraflow flue channels. The invention is directed to a new replaceable throat construction for the tapered throat that provides a flue coupling between the primary combustion firebox and the secondary combustion chamber or bakeoven of the masonry heater.

BACKGROUND ART

The Finnish masonry heater tradition is several hundred years old. The down draft contraflow masonry heater currently used is well over one hundred years old. In the Finnish masonry heater design super heated gases move up a central fire tube or heater core to the top of the heater. Flue gases then drop down heat exchange channels on both sides of the heater core giving off heat to the exterior brick shell or wall of the masonry heater which in turn heats the surrounding space by convection, radiation and conduction. The cooled fluegases enter a common channel or manifold at the base of the heater and exit into a chimney flue behind or to either side of the heater. Once a burn is completed, dampers in the chimney flue are shut and the entire mass radiates heat for the next twelve to twenty-four hours.

A traditional Finnish masonry heater and bakeoven combination is illustrated in FIGS. 1 and 2. The masonry heater 10 is constructed with an outer shell or outer wall 12 of courses of common brick and mortar defining the outer surface or outer perimeter 14 of the masonry heater. The word "common" is used herein to refer to common construction bricks and portland cement based mortar not necessarily incorporating refractory materials. A double layer outer wall is shown at the sides of the masonry heater to conform with fire code requirements. Facades other than common brick may be used for the outer wall such as stone, soapstone, cast blocks, sheet metal, etc. The masonry heater 10 is also constructed with an inner core 15 of refractory material which confines the primary and secondary combustion flue gases. The refractory core 15 defines an inner perimeter 16 of the masonry heater. The inner core 15 is typically constructed of courses of refractory material firebrick mortared with a clay based refractory mortar.

The refractory core 15 is constructed to define a primary combustion firebox 18 with firebox access door 20 for combustion of, for example, wood fuel. An ash pit 22 of common brick and an ash clean out door 24 are provided below the firebox 18. The core construction also includes a bakeoven 25 above the firebox 18 with bakeoven access door 26 according to the masonry heater construction developed by Heikki Hyytiäinen and Erkki Salmela of Finland. In this example the bakeoven door 26 is on the opposite side from the firebox door 20. The bakeoven 25 also functions as a secondary combustion chamber. If the chamber 25 functions only as a secondary combustion chamber and not as a bakeoven, then the bakeoven door 26 is eliminated. In the case of a bakeoven 25, the bakeoven door 26 may alternatively be provided on the same side as the firebox door 20.

Bakeoven flue outlets 28 are provided at the top of the bakeoven 25 leading to the contraflow flue channels 30. The contraflow flue channels 30 extend from the top of the masonry heater back to a chimney outlet manifold 32 at the bottom of the masonry heater. The chimney is coupled to the masonry heater at the bottom of the masonry heater where the temperature is lower and there is less heat stress on the chimney masonry heater joint.

The top of the bakeoven 25 is formed with an arched ceiling provided by a cast refractory bakeoven arch 27. Flue gases pass from the bakeoven 25 through the bakeoven flue outlet 28 and through a tertiary chamber 29 coupled with the contraflow flue channels 30. Combustion of flue gases is substantially completed as the flue gases pass through the tertiary space 29 to the contraflow flue channels 30 for exchange of heat to the outer shell 12 of the masonry heater. Air in the space being heated rises up the sides of the outer perimeter 14 in the opposite direction from the contraflow flue gases in channels 30.

The refractory core 15 is also constructed to provide a tapered throat section 35 which provides a flue coupling between the firebox 18 and secondary combustion chamber bakeoven 25. The tapered throat is generally constructed with straight sidewalls at the inner perimeter 16 of the core 15 over the sides of the firebox 18, and asymmetrical sloping front wall 36 and back wall 38. The tapered throat 35 therefore provides a relatively large flue opening at the base of the throat forming a flue outlet over the firebox 18 and a relatively small flue opening at the top of the throat forming a flue inlet to the bakeoven 25. The asymmetry of the sloping front wall 38 of tapered throat 35 has traditionally been used in order to permit enlargement of the firebox at the back of the masonry heater. At the same time, the flue inlet to the bakeoven is retained at one end to maximize continuous bakeoven floor area. The flue outlet from firebox 18 is therefore skewed to the front of the firebox.

There are several disadvantages associated with this traditional throat construction for masonry heaters. First, the asymmetry of the sloping front wall 36 and back wall 38 directs and reflects heat to the front of the firebox concentrating excessive thermal stress on the lintel 40 which supports the weight of the masonry heater over the firebox door 20. The lintel 40 is typically a cast refractory reinforced beam or a metal beam. This skewing of heat stress to the front of the firebox also complicates the design and construction of "see-through" type fireplaces and fireboxes. Second, thermal stress is distributed unevenly along the front and back walls of the throat. The asymmetry is aggravated as the firebox or fireplace is enlarged to the rear. Finally, the asymmetrical location of the flue inlet to the bakeoven 25 concentrates thermal stress on the inner wall of the bakeoven or secondary combustion chamber. Uneven distribution of thermal stresses may cause premature breakdown of the mortared refractory materials repairable only at great expense by tearing down portions of the masonry heater.

Further background and details of construction of Finnish fireplaces and the combination masonry heater and bakeoven can be found in the paperback books *Finnish Fireplace Construction Manual* 1984, by Albert A. Barden, III, published 1984 by Maine Wood Heat Company, Inc., RFD 1, Box 640, Norridgewock, Maine USA 04957; and *Finnish Fireplaces Heart of the Home* by Albert Barden and Heikki Hyytiäinen, published by Heikki Hyytiänen and Building Book Ltd., Finland, c/o Maine Wood Heat Company, Inc., RFD1, Box 640, Norridgewock, Maine USA 04957.

To alleviate some of these problems associated with the combination masonry heater and bakeoven of FIGS. 1 and 2, the present inventor developed a new tapered throat configuration with two major differences from the throat construction illustrated in FIGS. 1 and 2. First, in the Barden throat configuration manufactured by Maine Wood Heat Company, Inc., under the TM "Albiecore" the sloping sides of the tapered throat are symmetrical so that the relatively narrow flue opening at the top of the throat is centered over the relatively wider flue opening at the base of the throat. Second, the tapered throat is rotated 90° so that the sloping sides of the throat are positioned over the sides of the firebox rather than the front and back walls.

The new Barden throat configuration affords several advantages. First the heat stress formerly concentrated over the lintel 40 and front of the firebox is displaced and redistributed to the center of the firebox from front to back. The thermal stress is distributed more evenly over the surfaces of the throat although the area over the lintel remains the hottest part of the masonry heater. Second, the firebox or fireplace may be enlarged to the rear while maintaining symmetry to any depth. Furthermore, the Barden throat configuration favors "see-through" firebox and fireplace designs. Third, the flue gases passing through the flue opening at the top of the throat which forms the flue inlet to the bakeoven can form two vortices or eddies for greater distribution around the surfaces of the bakeoven rather than concentrating the flue gases and consequent heat stress at the inner wall of the bakeoven.

Even with the improvements of the Barden configuration tapered throat with symmetrical sloping sides, the masonry heater throat remains the area of greatest concentration of thermal stress. Over time this may lead to incremental breakdown of refractory material firebricks or other refractory material lining the throat. Because of the location of the combustion throat in the heart of the massive masonry heater surrounded by the refractory core and outer shell, repairs can generally be achieved only by tearing down portions of the masonry work.

OBJECTS OF THE INVENTION

It is therefore an object of the present invention to provide a new tapered throat construction for masonry heaters using unmortared replaceable refractory throat elements which are replaceable in the event of breakdown of the refractory material caused by concentrated thermal stresses.

Another object of the invention is to provide a new tapered throat construction of unmortared replaceable refractory throat elements accessible through the bakeoven door and bakeoven chamber of a combination masonry heater and bakeoven. Alternatively, the secondary combustion chamber is provided with an access door for access to the tapered throat.

A further object of the invention is to provide a new tapered throat construction of unmortared replaceable refractory throat elements constructed in configurations that rest on each other in a self supporting structure in the core of the masonry heater between the firebox and secondary combustion bakeoven.

DISCLOSURE OF THE INVENTION

In order to accomplish these results the invention provides a masonry heater having a combustion confining core of refractory material construction. The core includes a primary combustion firebox with a fuel access firebox door, a secondary combustion chamber bakeoven over the firebox with a bakeoven access door, and a tapered throat providing a flue coupling between the firebox and bakeoven.

According to the invention the tapered throat is formed by a plurality of unmortared replaceable flat refractory bricks accessible for replacement through the bakeoven door. The flat refractory bricks are constructed in configurations to rest on each other and provide a structurally self supporting tapered throat with at least two sloping sides. The core is constructed with shelf projections for supporting the unmortared replaceable flat refractory bricks forming the tapered throat.

In the preferred example the core is constructed with successive courses of firebrick mortared with refractory mortar. A first set of shelf projections is provided by a first course of shelf firebricks at least some of which are formed with projecting edges forming shelves projecting from the inner perimeter of the core toward the inside of the core. The first set of shelf projections are positioned at the base of the throat to support the flat refractory bricks which form the tapered throat structure. A second set of shelf projections is provided by a second course of shelf firebricks at least some of which firebricks are formed with projecting edges forming shelves projecting from the inner perimeter into the core. The second course of shelf firebricks is spaced above the first course of firebricks near the top of the throat. The bakeoven is formed with removable and replaceable refractory floor elements which rest on the second set of shelf projections and on the throat elements and which afford access to the tapered throat through the bakeoven access door. The bakeoven floor elements are formed with an opening for the bakeoven flue inlet.

In the preferred example, the flat refractory bricks which form the tapered throat are constructed with beveled side edges for resting against each other at the beveled side edges for expansion and contraction movements relative to each other in response to heat stresses. In the preferred example the flat refractory elements are constructed in configurations to define a tapered throat in the assembled configuration of a truncated wedge. Alternative configurations and arrangements are also described.

Other objects, features and advantages of the invention are apparent in the following specification and accompanying drawings.

BRIEF DESCRIPTION OF THE DRAWINGS

FIG. 6 is a fragmentary diagrammatic perspective view of the refractory firebricks which form the new replaceable throat construction according the invention extracted from the core while

FIG. 8 is a fragmentary diagrammatic perspective view of the tapered throat structure extracted from FIGS. 4 and 5 while

DESCRIPTION OF PREFERRED EXAMPLE EMBODIMENTS AND BEST MODE OF THE INVENTION

Figure 1:
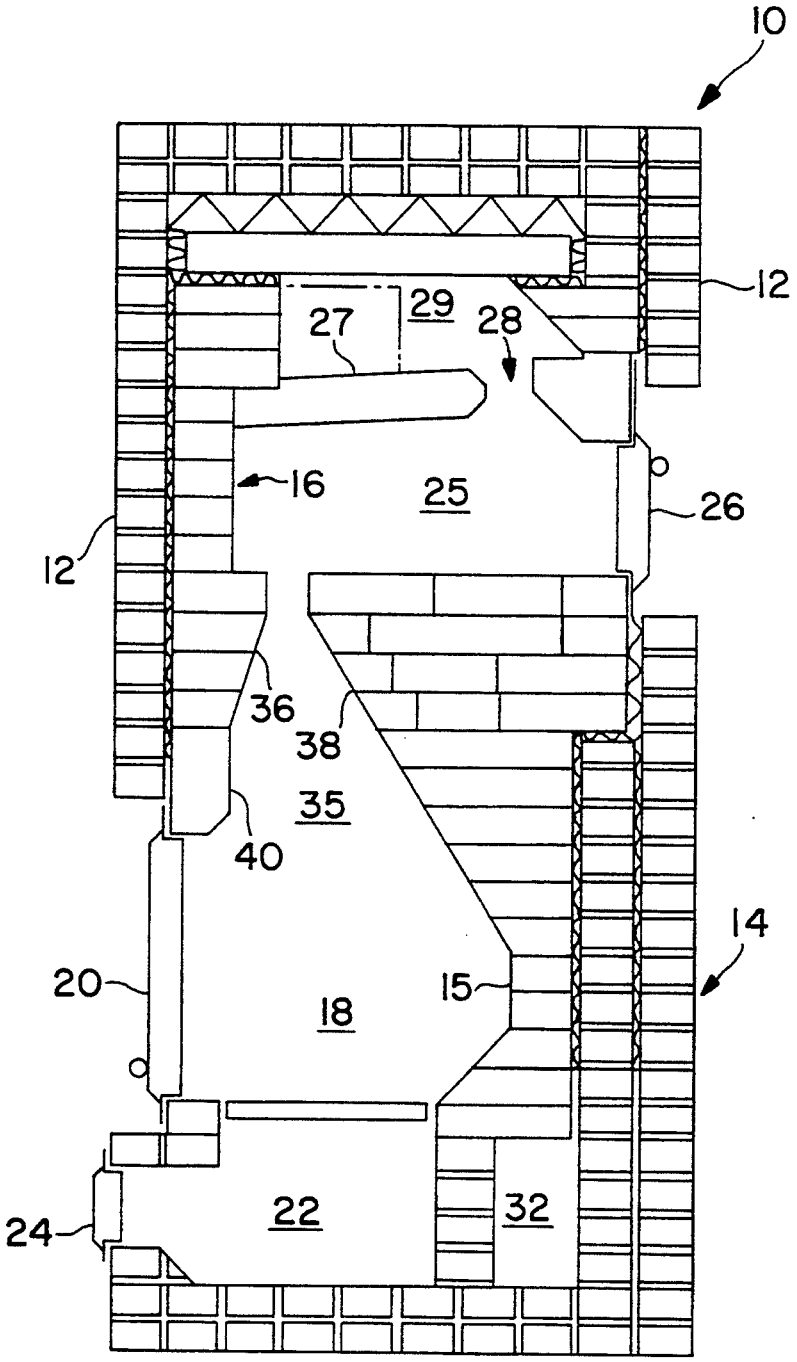
FIG. 1 (PRIOR ART)
FIG. 1 is a simplified diagrammatic side view of a traditional prior art masonry heater and bakeoven combination with the side of the outer shell and core cut away.
Figure 2:
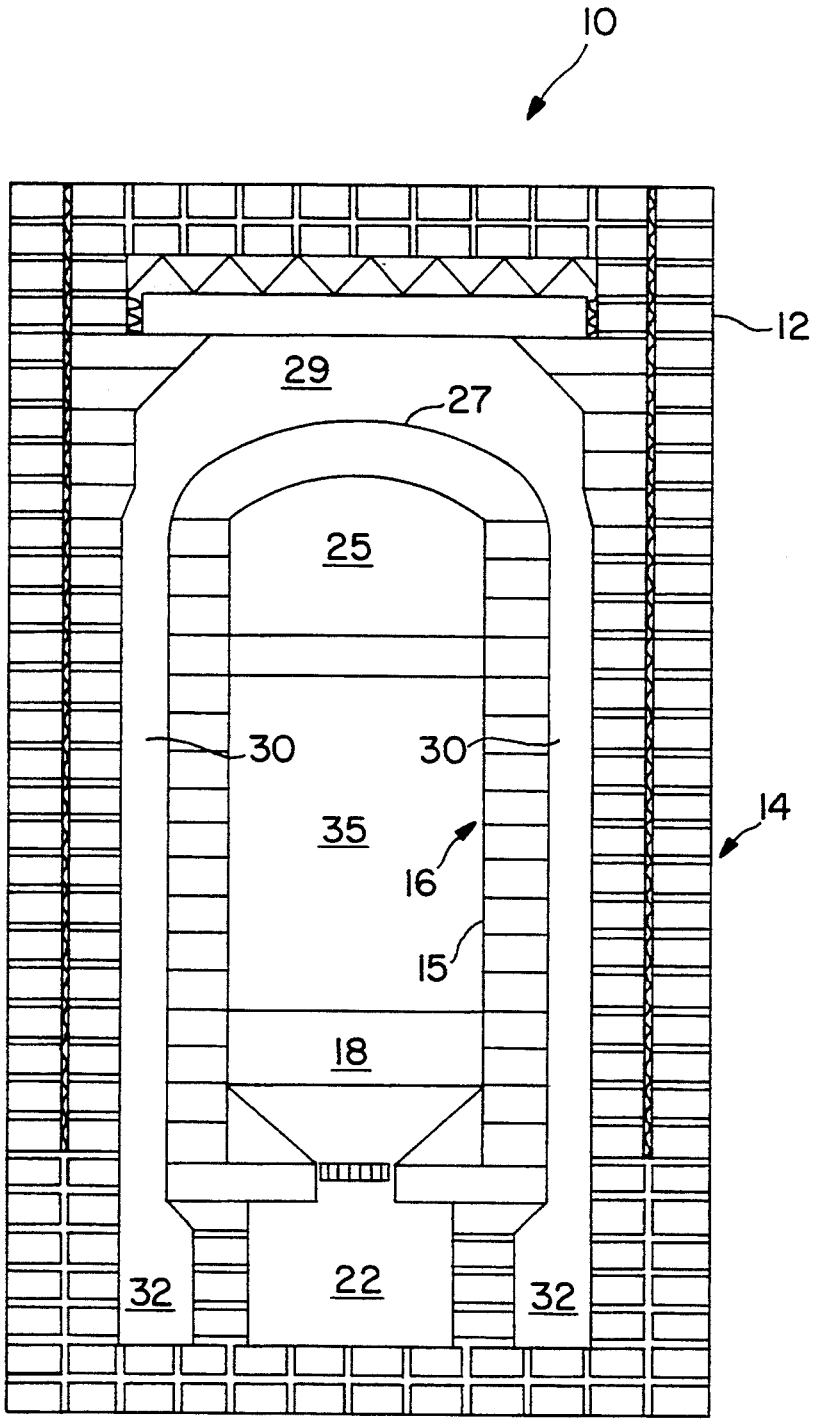
FIG. 2 (PRIOR ART)
FIG. 2 is a simplified diagrammatic cutaway front view of the combination masonry heater and bakeoven of FIG. 1.
Figure 3:
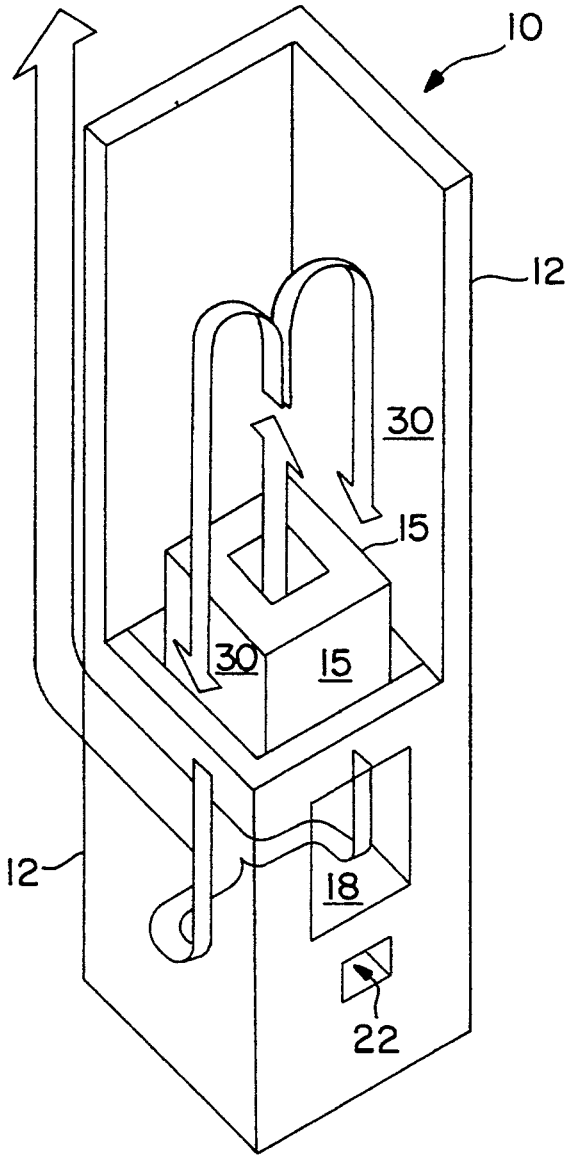
FIG. 3 (PRIOR ART)
FIG. 3 is a simplified diagrammatic cutaway perspective view of fragmentary portions of a masonry heater illustrating the principle of contraflow flue gas movement in the masonry heater.
Figure 4:
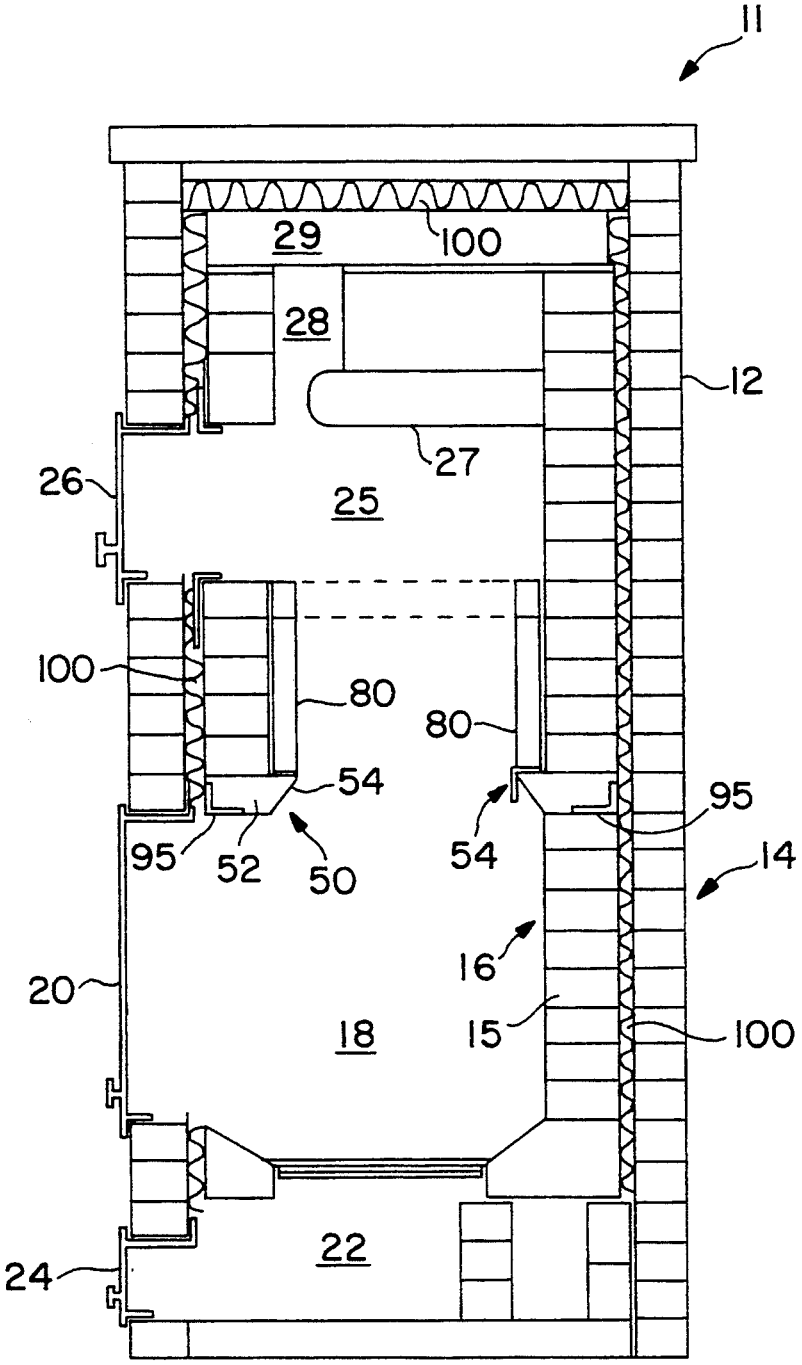
FIG. 4 is a simplified partial or fragmentary diagrammatic cutaway side view of a combination masonry heater and bakeoven incorporating the replaceable throat construction according to the invention with the side of the outer shell and core cut away.
Figure 5:
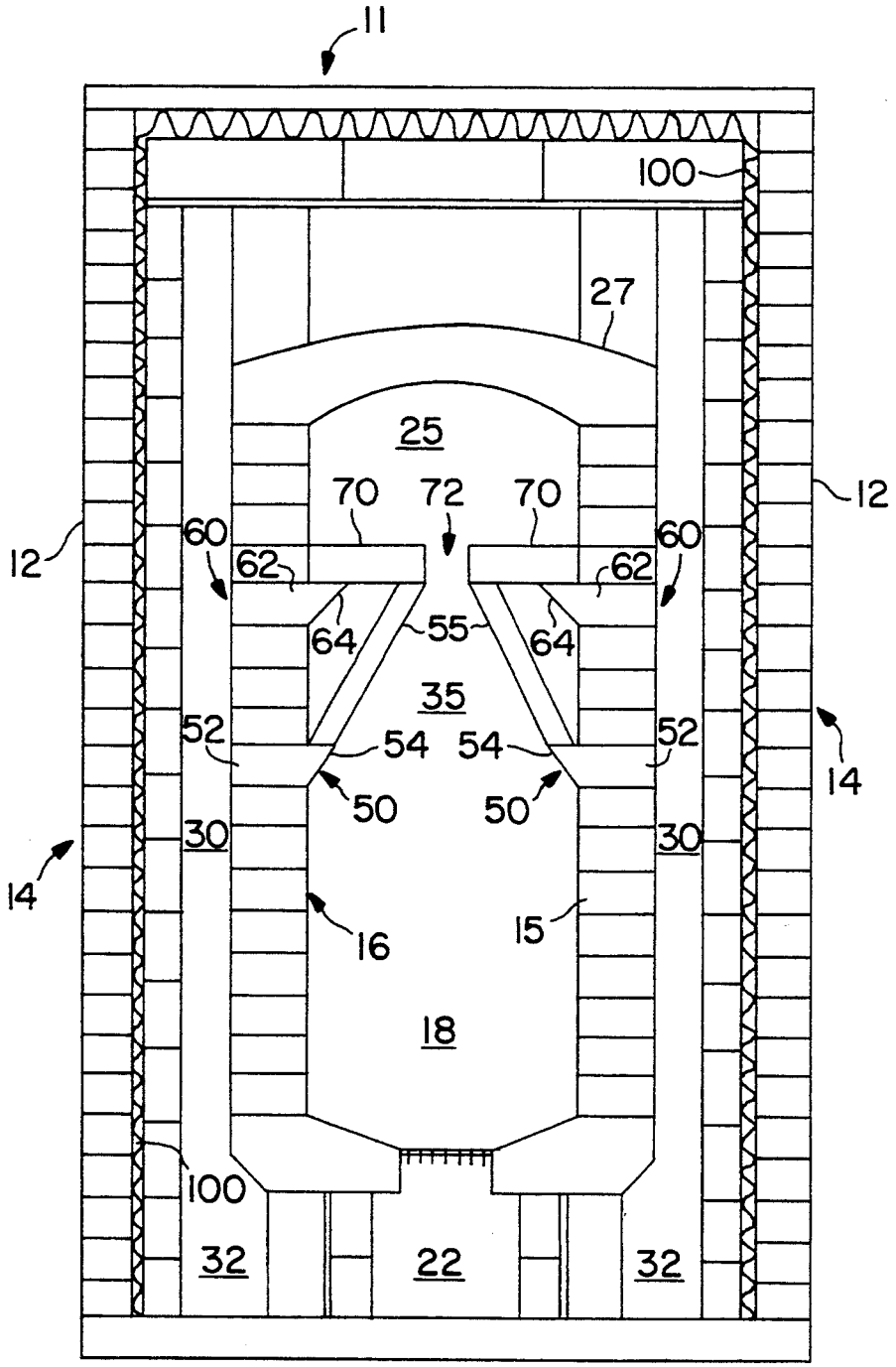
FIG. 5 is a simplified diagrammatic cutaway front view of the combination masonry heater and bakeoven of FIG. 4 with the front of the outer shell and core cut away.

A combination masonry heater and bakeoven incorporating the new replaceable throat construction is illustrated in FIGS. 4 and 5. Elements of the new masonry heater 11 corresponding to the elements of the combination masonry heater and bake oven of FIGS. 1 and 2 are indicated by the same reference numerals. According to the new throat construction, the core 15 is built up by successive courses of refractory firebricks which are mortared in place with refractory mortar and which incorporate first and second spaced apart courses of shelf firebricks. The first course 50 of shelf firebricks 52 is placed above the firebox 18 at the base of the throat 35 and incorporates at least some firebricks 52 formed with projecting edges 54 which function as shelves or shelf projections projecting from the inner perimeter 16 toward the inside of the core. The shelf projections 54 support the unmortared and replaceable tapered throat structure 55 hereafter described.

A second course 60 of shelf firebricks also incorporates at least some firebricks 62 formed with projecting edges 64 which provide shelves or shelf projections projecting from the inner perimeter 16 of the core 15 toward the inside of the core. The second course 60 of shelf firebricks 62 is placed at the top of the throat 35 and at the bottom of the bakeoven 25. The shelves or shelf projections 64 function to support bakeoven refractory brick floor elements 70. The bakeoven floor elements 70 leave an opening 72 coinciding with the flue opening at the top of the tapered throat structure 55. The top of the tapered throat structure 55 also serves to support the bakeoven refractory floor elements 70.

It is noted that in the tapered throat construction of FIGS. 4 and 5 certain refractory brick elements are not mortared to the core structure 15 or to each other as hereafter described. The refractory brick throat elements of the tapered throat structure 55 are not mortared to each other as hereafter described nor are they mortared to the shelf projections 54. Similarly the bakeoven refractory brick floor elements 70 are not mortared to the core structure 15 nor to the shelf projections 64. The identified refractory brick elements 55 and 70 are unmortared and replaceable in the manner hereafter further described. The first course of shelf brick elements 50 and second course of shelf brick elements 60 form part of the courses building up the core structure and can be mortared into place at the locations shown in FIGS. 4 and 5.

The second set or second course 60 including shelf firebricks 62 is spaced above the first set or first course 50 including shelf firebricks 52. In the example of FIGS. 4 and 5 the second course 60 of shelf firebricks is the fourth course above the first course 50 of shelf firebricks. For standard American firebrick in the size range of for example 9"×2½"4½"(22.5 cm×6.25 cm×11.25 cm). With a thickness of 2½ (6.25 cm) each, the four courses span a height of approximately 10" (25 cm) which represents the height span or height depth of the tapered throat structure 55.

Figure 6:
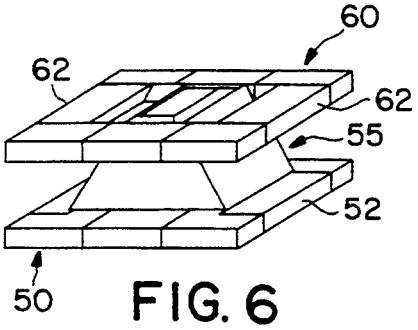
Figure 6A:
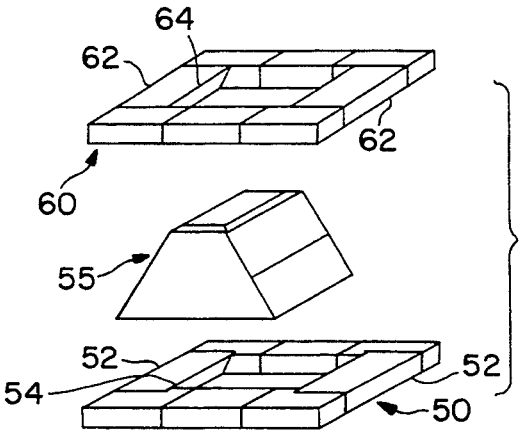
FIG. 6A is an exploded view of FIG. 6.

The refractory brick elements essential to the new tapered throat construction are extracted from the core 15 of masonry heater 11 and are shown separately in FIGS. 6–10. All of the refractory brick elements of the tapered throat structure are shown in isolation from the core in FIG. 6 including the first course 50 of shelf firebricks 52, second course 60 of shelf firebricks 62, and tapered throat structure 55. An exploded view of components 50,55 and 60 is shown in FIG. 6A. The first course 50 of 8 firebricks incorporates at least some shelf firebricks 52 with shelf projections 54 forming the shelf that supports the tapered firebrick structure 55. The first course 50 of shelf firebricks 52 may be mortared into the core. The tapered throat structure 55 is composed of flat refractory brick throat elements which are not mortared together as hereafter described. The second course 60 also of 8 firebricks incorporates at least some shelf firebricks 62 with shelf projections 64 that support the bakeoven refractory brick floor elements 70 as further described.

Figure 7:
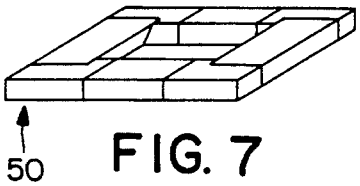
FIG. 7 is a fragmentary diagrammatic perspective view of one of the courses of firebricks of the core of the masonry heater forming the shelf projections for supporting the tapered throat or supporting the removable and replaceable bakeoven floor elements.
Figure 7A:
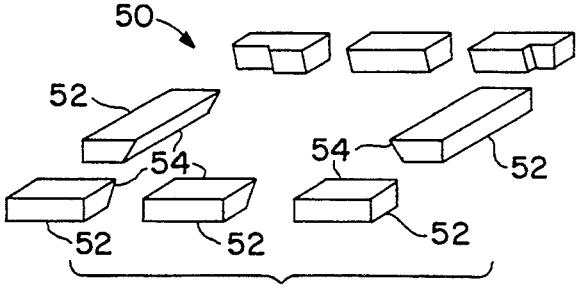
FIG. 7A is an exploded view FIG. 7.

By way of example the first course 50 as well as the second course 60 incorporates for example five shelf firebricks 52 with shelf projections 54 as shown in FIGS. 7 and 7A. Except for the side with shelf projections 54, the remaining sides of the shelf firebricks 52 are flat for appropriately fitting into the successive courses of firebrick forming the core 15.

Figure 8:
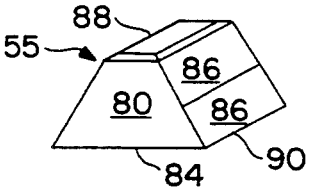
Figure 8A:
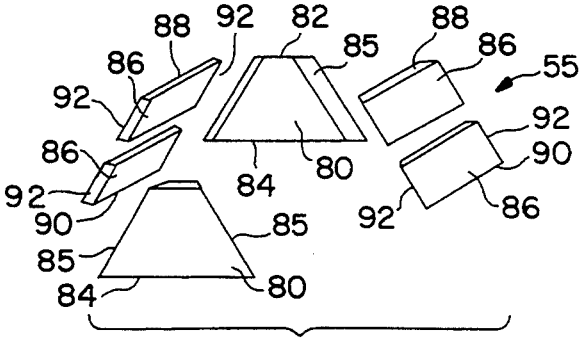
FIG. 8A is an exploded view of FIG. 8.

Exemplary flat firebrick configuration throat elements for the tapered throat structure 55 are illustrated in FIGS. 8 and 8A. According to this example the flat refractory brick throat elements are constructed in configurations to rest and seat against each other and form a stable tapered throat structure in the configuration of a truncated wedge. The flat refractory brick throat elements include a pair of opposing flat refractory bricks in the configuration of similar trapezoids 80. The flat trapezoidal refractory bricks 80 are oriented in the vertical direction and aligned parallel with respect to each other. Trapezoid refractory brick throat elements 80 are formed with flat bottom edges 84 for resting on the shelf projections 54 of the first course 50 of shelf firebricks. The trapezoid firebricks 80 are formed with flat top edges 82 so that the flat bakeoven refractory brick floor elements 70 can rest in part on the flat edges 82. The trapezoid firebricks 80 are also formed with sloping beveled side edges 85 for receiving the sloping side elements of the tapered throat structure 55.

The sloping sides of the tapered throat structure 55 are provided by two pairs of elongate rectangular flat firebricks 86, one pair on each side of the throat. Each of the elongate rectangular flat firebricks 86 is formed with flat horizontal top and bottom edges 88 for resting flush against each other in the assembled position, so that the flat horizontal bottom edge 90 can rest flush against the shelf projections 54 of the first course 50 of shelf firebricks, 52, and so that the flat horizontal top edges 88 can rest flush against and support the bakeoven refractory brick floor elements 70. Alternatively, each of the pairs of elongate flat firebricks 86 can be formed as a single piece of flat firebrick 86/86 forming a one piece sloping side of the tapered throat structure 55.

More importantly the sides 92 of the flat elongate rectangular firebricks 86 are formed with beveled side edges complementary with the sloping beveled side edges 85 of the trapezoid firebricks 80. By way of example, all of the beveled side edges may be cut at 45°. As a result the flat elongate rectangular firebricks 86 interfit and lie against the trapezoid firebricks 80 forming the sloping side walls of the tapered throat structure. The beveled side surfaces permit the assembled firebrick elements 80 and 86 to form a self supporting and self sustaining tapered throat structure 55 resting on the first set of shelf projections 54 of the first course 50 of shelf firebricks 52 and in turn supporting the bakeoven firebrick floor elements 70 in cooperation with the second set of shelf projections 64 of the second course 60 of shelf firebricks 62.

The respective flat firebrick throat elements 80 and 86 are assembled together unmortared forming a self supporting tapered throat structure under the forces of gravity. This construction arrangement permits the constituent firebrick elements 80,86 to move and slide relative to each other in all directions in response to heating stresses. This construction furthermore permits the unmortared firebrick elements to be replaced with access for replacement through the bakeoven door.

Figure 9:
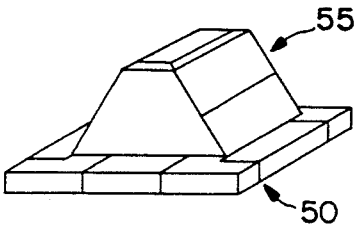
FIG. 9 is a detailed fragmentary perspective view showing the tapered throat structure of FIG. 8 resting on the first set of shelf projections provided by the first course of shelf firebricks illustrated in FIG. 7.
Figure 10:
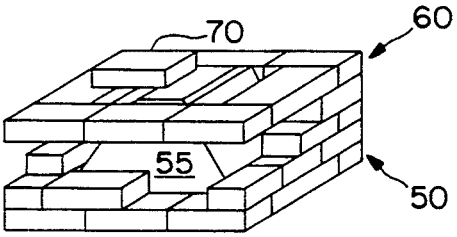
FIG. 10 is a detailed fragmentary perspective view of the refractory firebricks in the vicinity of the tapered throat showing portions of five courses of firebricks enclosing the tapered throat and showing the bakeoven refractory firebrick floor elements resting on the second set of shelf projections provided by the second course of refractory shelf firebricks and also resting on the top of the new tapered throat structure.

The assembled tapered throat structure 55, assembled without mortar, is shown resting on the first course 50 of shelf firebricks 52 in FIG. 9 in a truncated wedge configuration. For example bakeoven refractory brick floor element 70 is shown resting in turn on the top of the assembled tapered throat structure 55 as well as the second set of shelf projections 64 of the second course 60 of shelf firebricks 62 in FIG. 10. Also shown in FIG. 10 is partial assembly of the intermediate courses of firebricks between the first and second courses of shelf firebricks 50,60.

According to another configuration of the tapered throat construction of the present invention, the elongate rectangular flat firebricks 86 which form the sloping sides of the tapered throat may also be formed in the configuration of trapezoids similar to the trapezoidal flat firebricks 80. According to this configuration, both pairs of sides of the tapered throat are sloping forming a tapered throat in the configuration of a truncated pyramid. Other tapered throat configurations are also possible including a tapered circular throat in the overall configuration of a truncated cone.

In the embodiment of the present invention illustrated in FIG. 6–10, the new tapered throat construction is incorporated in the core of the masonry heater in the preferred construction of FIGS. 4 and 5 with the sloping sides of the truncated wedge shaped tapered throat aligned with the sides of the firebox or fireplace. Alternatively the tapered throat structure may be rotated 90° for incorporation into the core of the masonry heater. In that case the sloping sides of the wedge shaped tapered throat coincide with the front and back of the firebox or fireplace. This arrangement is useful for example where the masonry heater is constructed without a bakeoven but with an accessible secondary combustion chamber. The choice of alternative orientations for the tapered throat structure 55 is facilitated by constructing the first course 50 of shelf firebricks 52 to form a square opening and similarly forming the tapered throat structure 55 with a square base. This permits the option of 90° rotation for either side to side or front to back tapering. The front to back taper may be advantageous for use with an upper secondary combustion chamber in the event the upper chamber is not used for a bakeoven.

To assure support for the tapered throat structure 55 when assembled without mortar, the first course 50 of shelf fire bricks 52 is supported on angle irons 95. Similar containment angle irons are also positioned in strategic locations above and below the tapered throat structure and in the structural walls of the masonry heater 11, as shown in FIG. 4.

An additional feature of the masonry heater construction to reduce heat over the lintel area is illustrated in FIG. 4. A single or double layer 100 of mineral wool insulation is packed between the outer wall 12 of common brick or stone and the inner core wall 16 in the over-lintel area. In addition, the flat firebrick elements 80,86 of the tapered throat structure 55 may be cast with castable insulative material with increased "R" value to provide further protection of permanent parts of the masonry heater from heat stress.

While the invention has been described with reference to particular example embodiments it is intended to cover all modifications and equivalents within the scope of the following claims.

I claim:

1. A masonry heater having a combustion confining core of refractory material construction, said core including a primary combustion firebox with fuel access firebox door, a secondary combustion chamber bakeoven over the firebox with a bakeoven access door, and a tapered throat coupling the firebox to the bakeoven, the improved tapered throat construction comprising:

said tapered throat comprising a plurality of unmortared replaceable flat refractory bricks accessible for replacement through the bakeoven door, said flat refractory bricks being constructed in configurations to rest on each other and provide a structurally self supporting tapered throat with at least two sloping sides, said core being constructed with supports to support the unmortared replaceable flat refractory bricks forming the tapered throat.

2. The masonry heater of claim 1 wherein the tapered throat is constructed to taper from a relatively large flue opening at the base of the throat forming a firebox flue outlet over the firebox to a relatively smaller flue opening at the top of the throat forming a flue inlet to the bottom of the bakeoven, and wherein the sloping sides of the tapered throat are symmetrical so that the relatively smaller flue opening at the top of the throat is centered over the relatively large flue opening at the base of the throat.

3. The masonry heater of claim 2 wherein the tapered throat is constructed with two sloping sides oriented at the sides of the firebox rather than at the front and back of the firebox.

4. The masonry heater of claim 2 wherein the tapered throat is constructed in the configuration of a truncated wedge.

5. The masonry heater of claim 4 wherein the flat refractory bricks of the tapered throat comprise an opposing pair of vertically oriented flat refractory bricks in the configuration of similar trapezoids with flat top and bottom edges and sloping beveled side edges, and a plurality of elongate flat refractory bricks with flat horizontal top and bottom edges and beveled side edges resting on the sloping beveled side edges of the vertically oriented trapezoid configuration flat refractory bricks for forming the sloping surfaces of the tapered throat.

6. The masonry heater of claim 5 wherein the core is formed with shelf projections projecting from the core between the firebox and bakeoven for supporting the unmortared replaceable flat refractory bricks of the tapered throat.

7. The masonry heater of claim 6 wherein the core is constructed from successive courses of firebrick mortared with refractory mortar said shelf projections comprising a first course of firebricks in which at least some of the firebricks are formed with projecting edges forming shelves projecting from the core substantially at the base of the throat for supporting the tapered throat flat refractory bricks, said shelf projections also comprising a second course of firebricks in which at least some of the firebricks are formed with projecting edges forming shelves projecting from the core substantially at the top of the throat, said bakeoven comprising refractory floor bricks resting on the shelf projections from the second course of firebricks and on the top of the tapered throat while leaving open the flue opening at the top of the throat forming the flue inlet to the bakeoven.

8. The masonry heater of claim 1 wherein the tapered throat flat refractory bricks comprise a plurality of unmortared replaceable flat refractory bricks formed with beveled side edges for resting against each other at the beveled side edges, said refractory throat elements being constructed to define a throat in the configuration of a truncated wedge with symmetrical sloping sides.

9. A method of constructing and maintaining a masonry heater for extending the useful life of a masonry heater of the type having an inner core of refractory material construction including a primary combustion firebox, a secondary combustion chamber over the firebox, and a tapered throat coupling the firebox to the secondary combustion chamber comprising:

forming the core with supporting shelf projections at first and second locations between the firebox and secondary combustion chamber;

forming the throat of unmortared replaceable flat refractory bricks by constructing the flat refractory bricks with configurations to provide a structurally self supporting tapered throat having at least two sloping sides with the flat refractory bricks resting on each other;

supporting the tapered throat of unmortared replaceable flat refractory bricks on the shelf projections of the core at the first location;

forming the secondary combustion chamber with refractory firebrick floor elements and supporting the firebrick floor elements unmortared on the shelf projections of the core at the second location;

providing an access door through the secondary combustion chamber;

and replacing heat stressed flat refractory bricks of the tapered throat through the secondary combustion chamber access door.

10. A masonry heater having an outer wall defining an outer perimeter of the masonry heater, and a combustion containing inner core of refractory material construction defining an inner perimeter of the masonry heater, said core being constructed with a primary combustion firebox, a secondary combustion chamber over the firebox, and a tapered throat providing a flue coupling between the firebox and the secondary combustion chamber, said throat tapering from a relatively large flue opening at the base of the throat forming a firebox flue outlet over the firebox to a relatively small flue opening at the top of the throat forming a flue inlet to the bottom of the secondary combustion chamber, the improvement in tapered throat construction comprising:

said core being constructed with a first set of shelf projections extending from the inner perimeter defined by the core at a first location between the firebox and secondary combustion chamber for supporting the tapered throat at the inner perimeter;

said core being constructed with a second set of shelf projections extending from the inner perimeter defined by the core at a second location above the first set of shelf projections and substantially coinciding with the top of the throat;

said secondary combustion chamber being formed with a removable floor of refractory floor elements constructed to rest on the second set of shelf projections while leaving open the relatively small flue opening at the top of the throat forming a flue inlet to the bottom of the secondary combustion chamber;

said tapered throat comprising a plurality of unmortared replaceable refractory throat elements resting on each other and the first set of shelf projections, said refractory throat elements being constructed to form at least two sloping sides for the tapered throat and being constructed with configurations to provide a structurally self supporting tapered throat of replaceable refractory throat elements between the firebox and secondary combustion chamber;

said secondary combustion chamber being formed with an access door for access to the tapered throat for replacing unmortared refractory throat elements.

11. The masonry heater of claim 10 wherein the core is constructed from successive courses of firebrick mortared with refractory mortar, and wherein the first set of shelf projections comprises a first course of firebricks at least some of which firebricks are formed with projecting edges forming shelves projecting from the inner perimeter of the core into the core for supporting the tapered throat refractory throat elements.

12. The masonry heater of claim 11 wherein the second set of shelf projections comprises a second course of firebricks at least some of which firebricks are formed with projecting edges forming shelves projecting from the inner perimeter of the core into the core for supporting the refractory floor elements of the secondary combustion chamber.

13. The masonry heater of claim 12 wherein the refractory throat elements of the tapered throat comprise a plurality of flat refractory bricks formed with bevelled side edges for resting against each other at the bevelled side edges, said refractory throat elements being constructed to define a throat in the configuration of a truncated wedge.

14. The masonry heater of claim 13 wherein the refractory throat elements comprise an opposing pair of vertically oriented flat refractory bricks in the configuration of similar trapezoids with flat top and bottom edges and sloping beveled side edges, and a plurality of elongate rectangular flat refractory bricks with flat horizontal top and bottom edges and beveled side edges resting on the sloping beveled side edges of the vertically oriented trapezoid configuration flat refractory bricks for forming the sloping sides of the tapered throat.

15. The masonry heater of claim 14 wherein the sloping sides of the tapered throat are oriented at the sides of the firebox rather than at the front and back of the firebox.

16. The masonry heater of claim 14 wherein the sloping surfaces of the tapered throat are oriented at the front and back of the firebox.

17. The masonry heater of claim 15 wherein the secondary combustion chamber comprises a bakeoven and the secondary combustion chamber access door comprises a bakeoven access door.

18. The masonry heater of claim 10 wherein the sloping sides of the tapered throat are symmetrical so that the relatively small flue opening at the top of the throat is centered over the relatively large flue opening at the base of the throat.

19. The masonry heater of claim 10 wherein the tapered throat refractory throat elements comprise a plurality of flat refractory bricks formed with sloping beveled side edges for resting against each other at the beveled side edges, said refractory throat elements being constructed to define a throat in the configuration of a truncated pyramid.

20. The masonry heater of claim 10 wherein the secondary combustion chamber comprises a bakeoven and the secondary combustion access door comprises a bakeoven access door.

* * * * *